US008336530B2

(12) United States Patent
Wang

(10) Patent No.: US 8,336,530 B2
(45) Date of Patent: Dec. 25, 2012

(54) BASEBALL/SOFTBALL PITCHING DEVICE

(76) Inventor: Chi-Sung Wang, Taichung County (TW)

( * ) Notice: Subject to any disclaimer, the term of this patent is extended or adjusted under 35 U.S.C. 154(b) by 330 days.

(21) Appl. No.: 12/805,346

(22) Filed: Jul. 27, 2010

(65) Prior Publication Data

US 2012/0024277 A1 Feb. 2, 2012

(51) Int. Cl.
*F41B 3/03* (2006.01)

(52) U.S. Cl. ..... 124/16; 124/36

(58) Field of Classification Search ..... 124/7, 16, 124/36, 79

See application file for complete search history.

(56) References Cited

U.S. PATENT DOCUMENTS 3,470,859 A * 10/1969 Ponza ..... 124/7
4,254,755 A * 3/1981 Morgan et al. ..... 124/16
4,282,848 A * 8/1981 Kulesza et al. ..... 124/16
4,995,371 A * 2/1991 Kuizinas ..... 124/7
5,121,735 A * 6/1992 Hancock ..... 124/7
5,975,527 A * 11/1999 Winchester ..... 273/129 V
6,343,597 B1 * 2/2002 Spikes ..... 124/7

* cited by examiner

*Primary Examiner* — John Ricci

(57) ABSTRACT

A pitching device includes a case in which a shaft, a press board, a strike board, an activation unit and a slide are received. The press board and the strike board are located on two ends of the shaft, and a driving spring is mounted to the shaft so as to rotate the shaft. The strike board has a support member for receiving a ball and the activation unit controls the operation of the strike board. The balls are put in the slide. A release member is located between the slide and the support member to control entry of the ball into the support member. By continuously pressing the press board, the torsion force of the driving spring is stored. When the pedal unit is operated to release the activation unit, the strike board rotates by the torsion spring to through the ball in the support member.

12 Claims, 14 Drawing Sheets

BASEBALL/SOFTBALL PITCHING DEVICE

BACKGROUND OF THE INVENTION (1) Field of the Invention

The present invention relates to a pitching device, and more particularly, to a baseball/softball pitching device which can be operated by the hitter at a distance from the hitter.

(2) Description of the Prior Art

A conventional batting device for practicing batting skills is compact and portable, and the device is set in front of the hitter and the ball is thrown upward so that the hitter can practice to hit the ball. The hitter can only practice the skill that hit the ball in front of the batter and is completely different from the way that a pitcher throws from a distance. This type of practice skill is so basic that cannot meet the practical needs for most of the players. In addition, there are various speeds with various type of ball that the hitter will face in a real baseball game, so that the conventional pitching device is not an ideal pitching device.

Although there are professional pitching devices in the market, they are expensive and cannot be afforded for most of the players.

The present invention intends to provide a pitching device which throw balls at different speeds and types and the pitching device is operated by the hitter at a distance.

SUMMARY OF THE INVENTION

The present invention relates to a baseball/softball pitching device and comprises a case including multiple frames and a shaft is rotatably connected to the frames and has a one-way ratchet and a gear located at one end of the case, and a strike board is located at the other end of the case. The gear is driven by a chain and the one-way ratchet is engaged with a pawl to restrict the one-way ratchet to rotate in one direction only. The pawl is connected to a pull spring and the shaft has a driving spring connected thereto. A press board is connected to a first end of the chain and a second of the chain is connected to a return member. The driving spring stores torsion force by continuously pressing the press board.

The strike board has a support member for receiving a ball therein and a stop extends from a side of the strike board. An activation unit has a spring received therein and a protrusion is connected with a rope. The rope is connected with a pedal unit. The protrusion is engaged with the stop to hold the strike board at position. The strike board rotates by the stored force of the driving spring when the protrusion is removed from the stop, and the ball is thrown by the rotation of the strike board. A slide is located in the case and a release member is located between the slide and the support member. The release member controls the ball into the support member.

The primary object of the present invention is to provide a baseball/softball pitching device that pitches the ball in substantially a parabola trace and the ball can be pitched as different types of ball such as change ball.

Another object of the present invention is to provide a baseball/softball pitching device that is portable and safe, wherein the mechanical parts are received in the case.

Yet another object of the present invention is to provide a baseball/softball pitching device which can be operated at a distance form the hitter.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
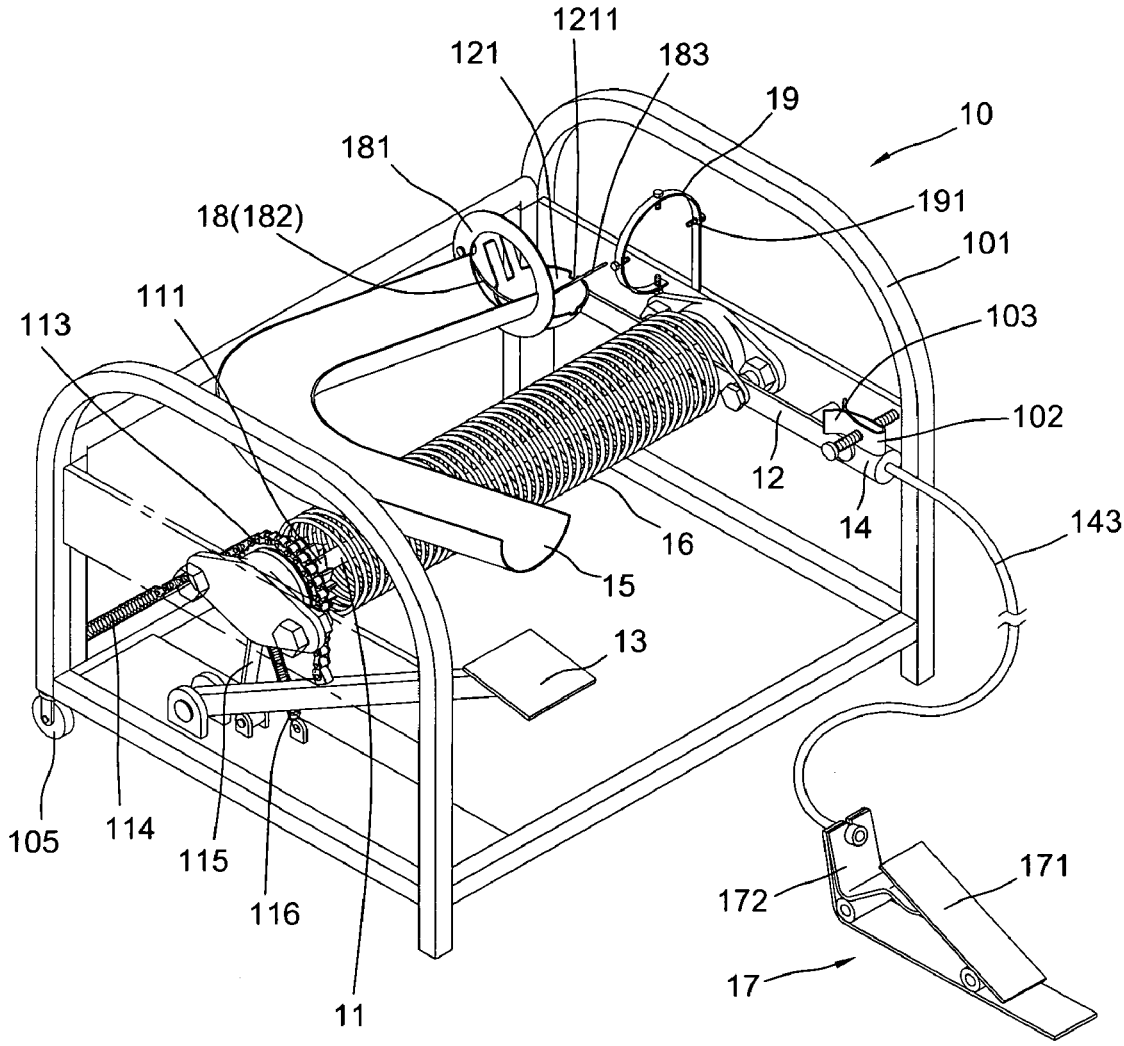
FIG. 1 is a perspective view to show the pitching device of the present invention.
Figure 2:
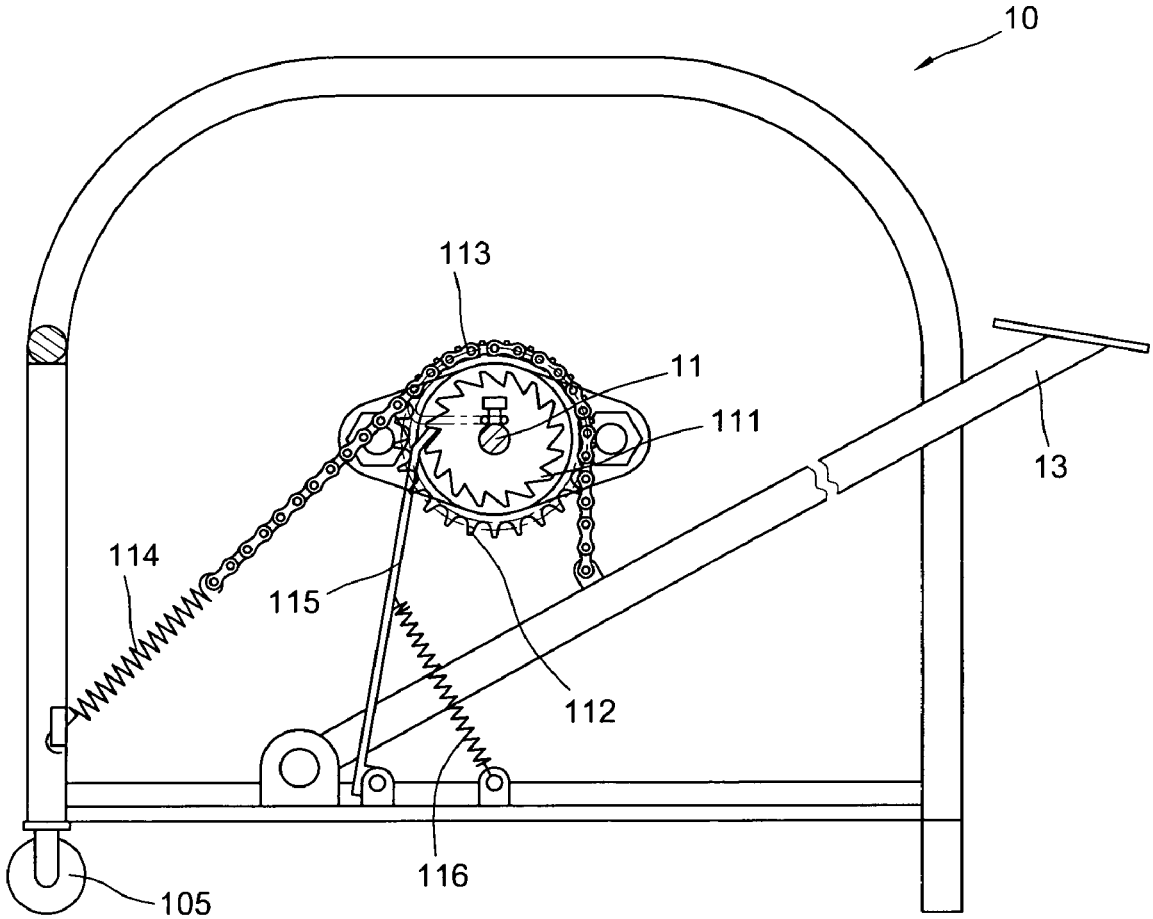
FIG. 2 is a side view to show the one-way ratchet and the gear of the pitching device of the present invention.
Figure 3:
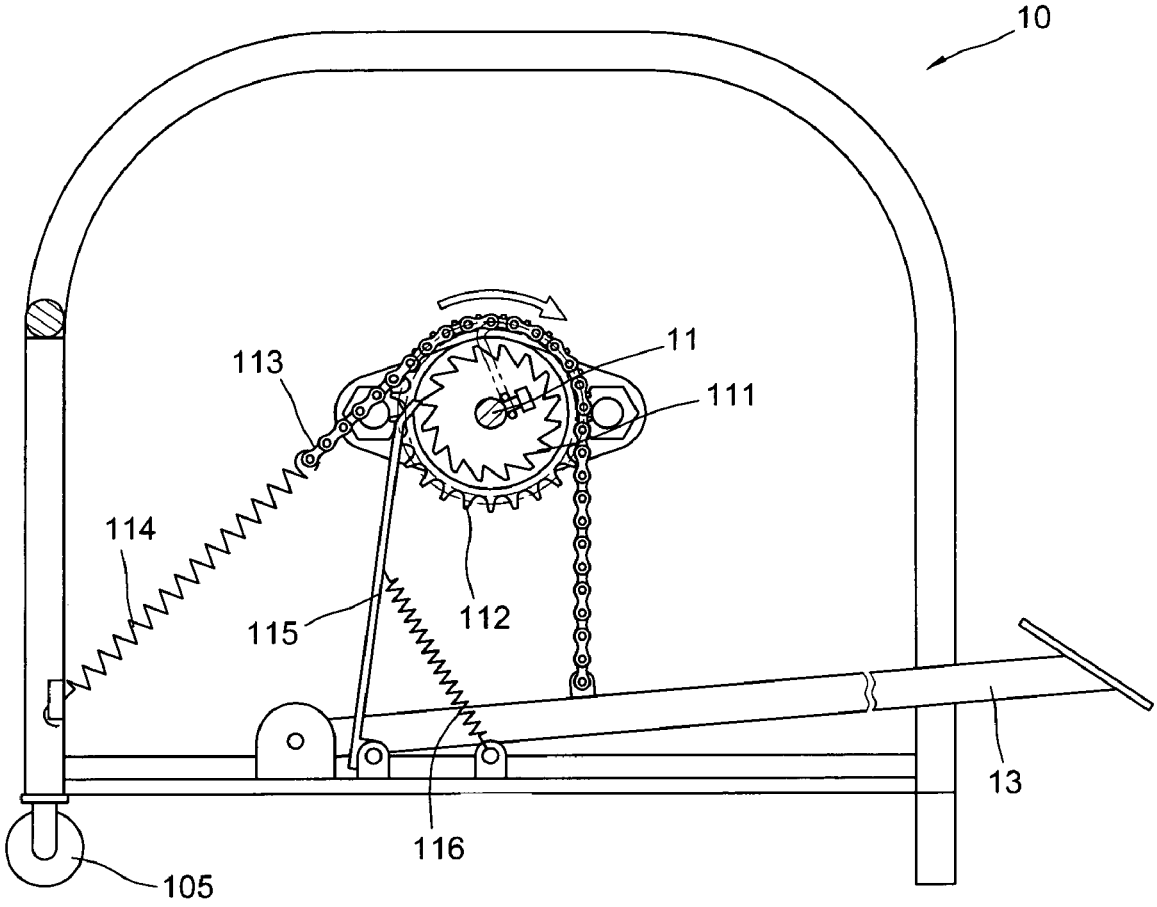
FIG. 3 shows the operation of the one-way ratchet and the gear of the pitching device of the present invention.
Figure 4:
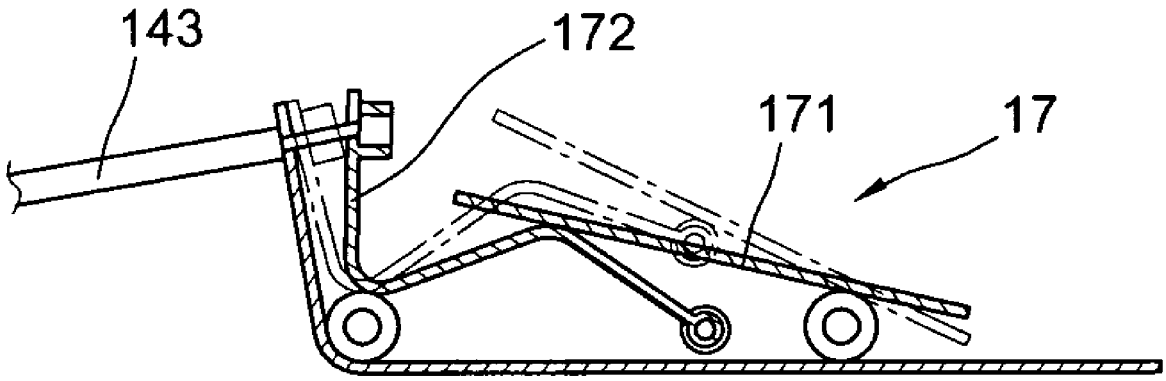
FIG. 4 shows the operation of the pedal unit of the pitching device of the present invention.
Figure 5:
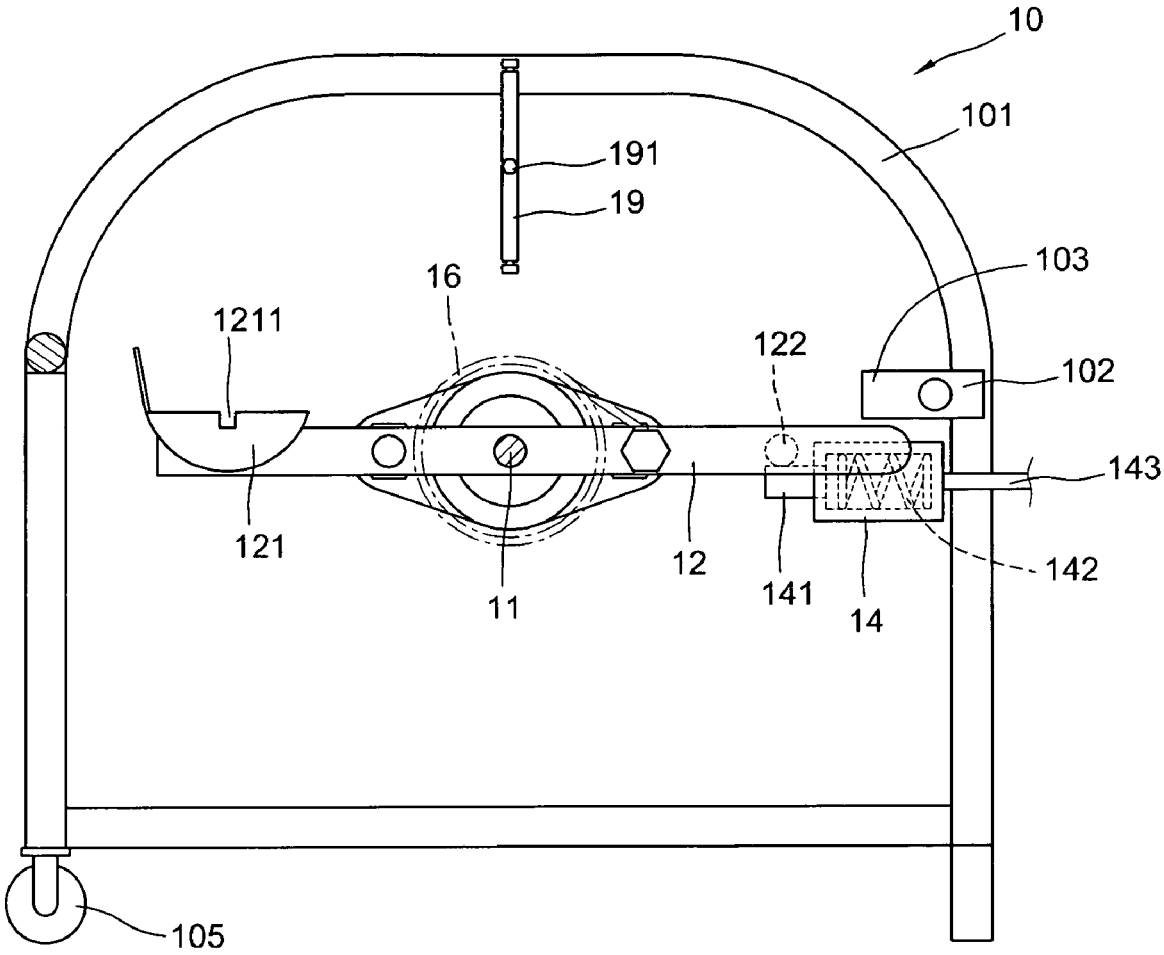
FIG. 5 shows the strike board, the support member and the stop of the pitching device of the present invention.
Figure 6:
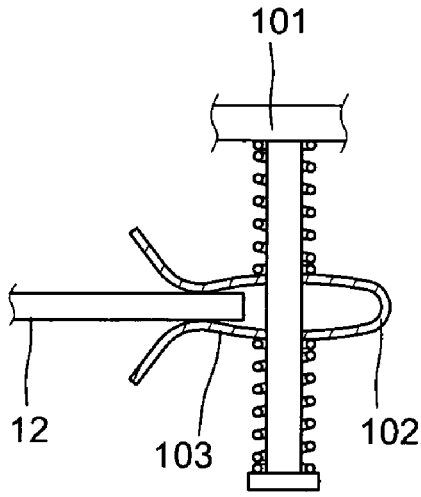
FIG. 6 is a cross sectional view to show the damper of the pitching device of the present invention.
Figure 7:
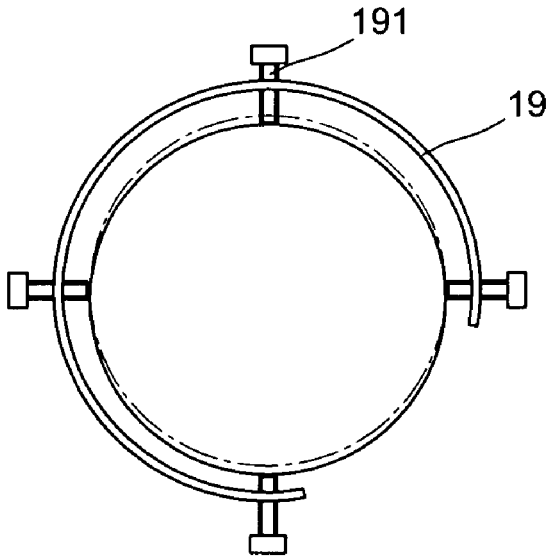
FIG. 7 shows the cross sectional view of the ring of the pitching device of the present invention.

Referring to FIGS. 1 to 7, the baseball/softball pitching device of the present invention comprises a case 10, a shaft 11, a strike board 12, a press board 13, an activation unit 14, and a slide 15. The case 10 comprises multiple frames 101 and an outer casing (not shown) is mounted to the frames 101. The shaft 11 is rotatably connected to the frames 101. A one-way ratchet 111 and a gear 112 are located at one end of the case 10 and a strike board 12 is located at the other end of the case 10. The gear 112 is driven by a chain 113 which has one end connected to the press board 13 and the user can continuously press the press board 13. The other end of the chain 13 is connected to a return member 114 which is a spring. The one-way ratchet 111 is engaged with a pawl 115 which restricts the one-way ratchet 111 to rotate in one direction only. The pawl 115 is a rod and connected to a pull spring 116. The shaft 11 has a driving spring 16 connected thereto. When the press board is continuously pressed, the gear 112 and the shaft 11 are rotated and the driving spring 16 stores torsion force. The driving spring 16 is a torsion spring.

The strike board 22 is an elongate board (FIG. 5) whose length is substantially equal to a diameter of a rotational path of the strike board 22. The support member 121 has multiple notches 1211. A stop 122 extends from a side of the strike board 12 and is stopped by a protrusion 141 of the activation unit 14. The activation unit 14 has a spring 142 received therein and the protrusion 141 is connected with a rope 143.

The rope 143 is connected with a pedal unit 17. The pedal unit 17 includes a pedal 171 and an upright board 172 which is connected to the rope 143. The upright board 172 pulls the rope 143 when the pedal 171 is pivoted. The strike board 12 rotates by the driving spring 16 when the protrusion 141 is removed from the stop 122.

The slide 15 is located in the case 10 and an end is exposed from the case 10. A release member 18 is located between the slide 15 and the support member 121. The release member 18 controls the ball into the support member 121. The release member 18 is a ring 181 and includes a resilient holding member 182. A push member 183 (FIG. 8) is connected to the holding member 182 and controlled by the support member 121 for not stopping a ball into the support member 121. When the strike board 12 rotates, the support member 121 pushes the push member 183 away and the ball can enter into the support member 121.

A collar 19 is connected to one of the frames 101 and has a multiple adjustment rods 191. When pitching a ball, the adjustment rods 191 touch the ball to control the type that the ball is thrown. The support member 121 has multiple notches 1211 so that when the support member 121 passes through the collar 19, the adjustment rods 191 pass through the notches 1211. The damper 102 is located on the rotational path of the strike board 12 and above the activation unit 14. The damper 102 is a U-shaped member 103 and includes a gap through which the strike board 12 passes. The strike board 12 touches the U-shaped member 103 which reduces the energy and speed of the strike board 12 when the strike board 12 passes through the gap. By this way, when the stop 122 of the strike board 12 hits the protrusion 141, no large sound is generated.

Figure 10:
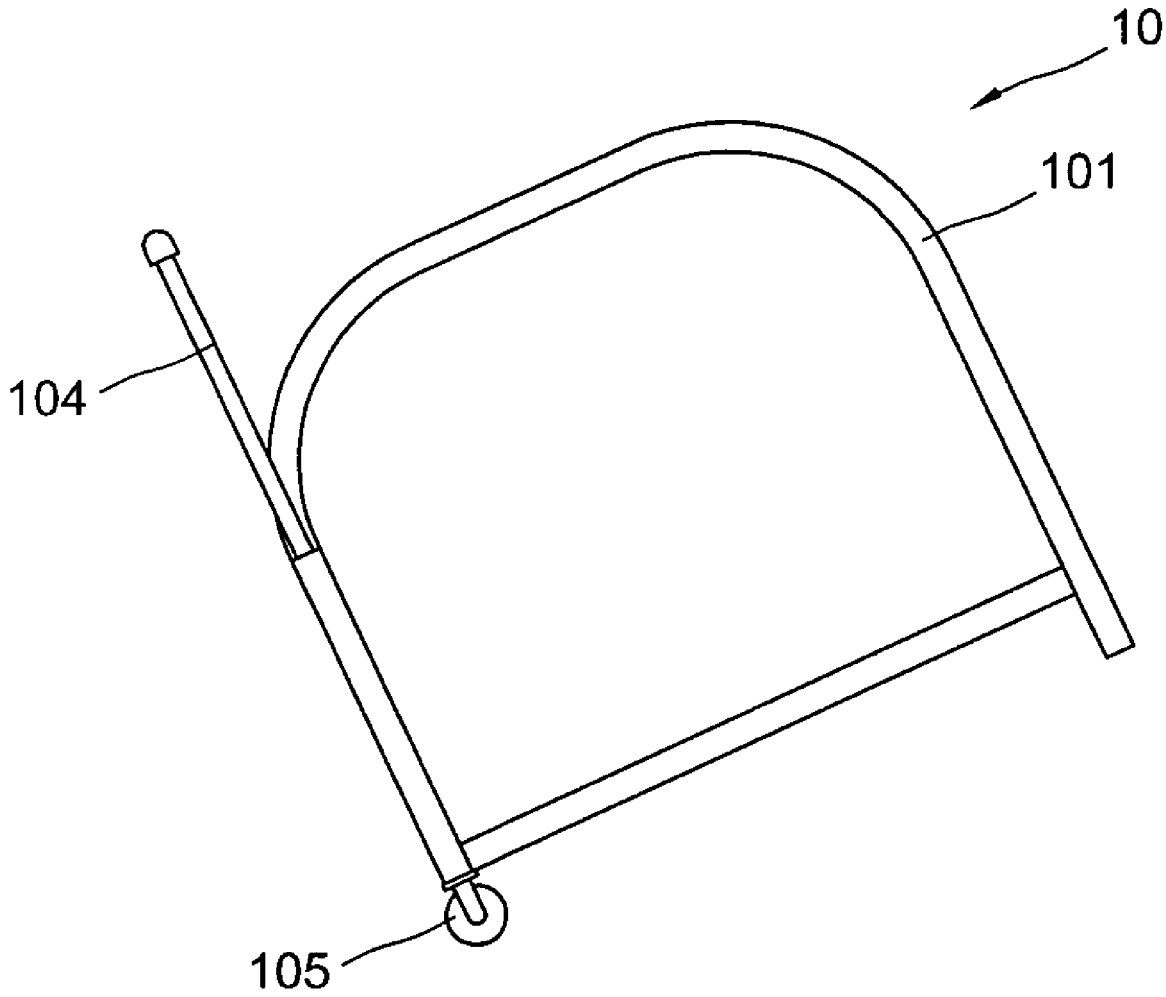
FIG. 10 shows the case is moved by the rollers.

As shown in FIG. 10, there is a retractable handle 104 is connected to the case 10 and two rollers 105 are connected to the underside of the case 10 so as to move the case 10 easily.

Figure 8:
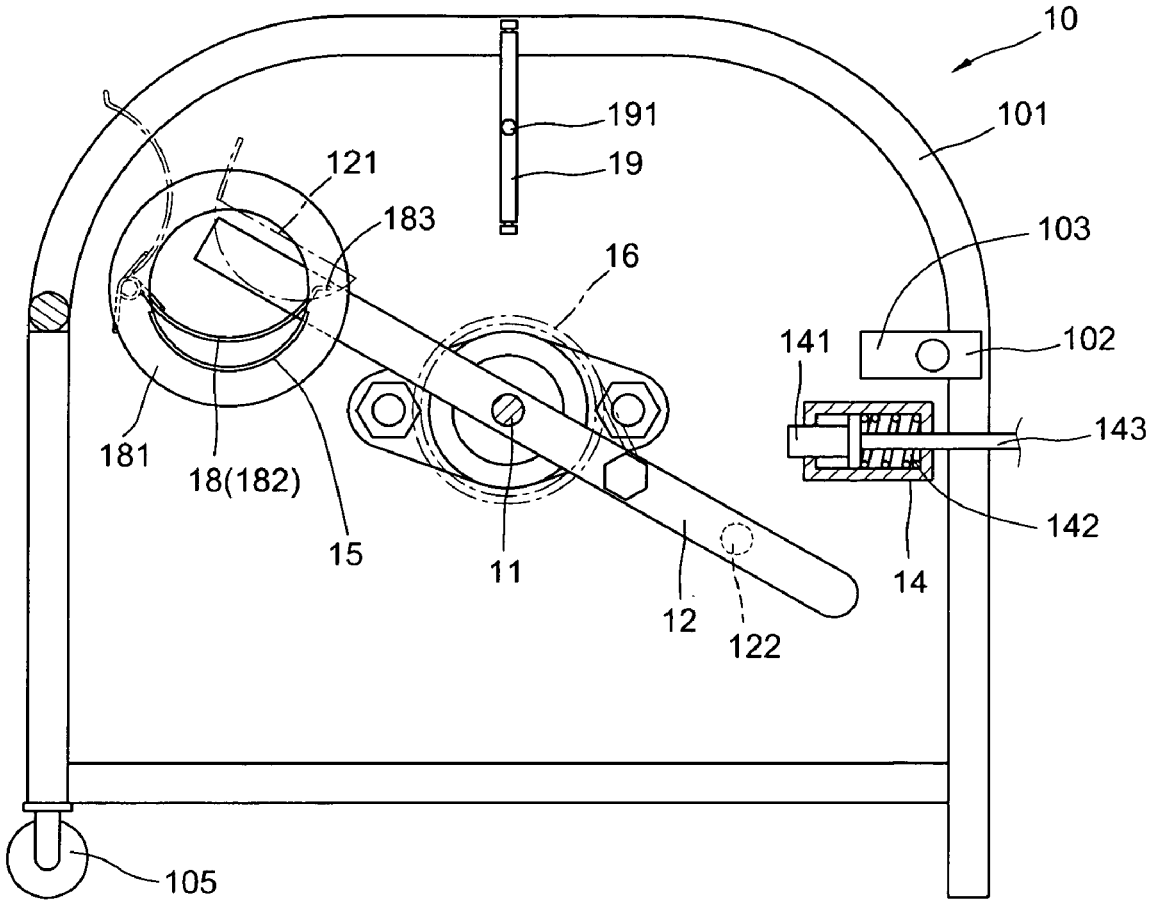
FIG. 8 shows that the strike board pushes the push member and the movement of the holding member.
Figure 9:
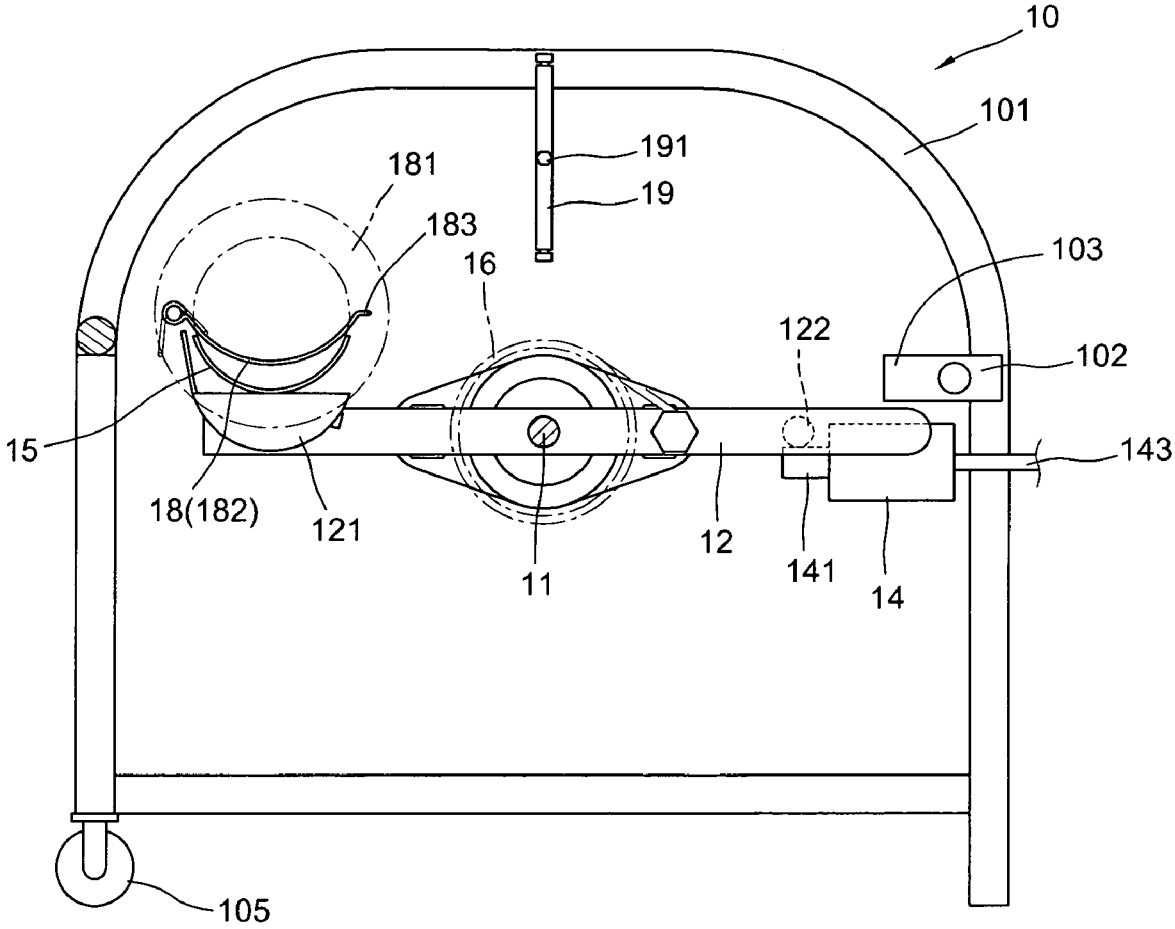
FIG. 9 shows that the strike board and the holding member return to the original positions.

When in operation, the user continuously presses the press board 13 to drive the chain 113 which rotates the gear 112, the shaft 11 and the one-way ratchet 111. The driving spring 16 are tightened to store torsion force. When the user's foot removes from the press board 13, the one-way ratchet 111 is not rotated reversely because of the pawl 115 and the torsion force is stored. The user then stands at a distance from the pitching device and presses the pedal 171 and then releases. The upright board 172 pulls the rope 143 to move the protrusion 141 and the strike board 12 rotates by the torsion force of the driving spring 16. The ball is thrown by the strike board 12 and the user swings the bat to hit the ball. After the strike board 12 rotates one revolution, the protrusion 141 stops the stop 122 of the strike board 12 again, the support member 121 returns to its original position. The push member 183 of the release member 18 is pushed by the rotation of the strike board 12, the holding member 182 is removed from the slide 15 as shown in FIGS. 8 and 9. When the strike board 12 and the support member 121 return to their original positions, the ball enters into the support member 121 via the slide 15, and the holding member 182 position the ball until next activation is proceeded. The ball is fed to the user one by one by pressing the pedal 171 until the stored torsion force runs out. Then the press board 13 needs to be pressed again.

The press board 13 can be pressed by using a motor and the movement of the protrusion 141 can be operated by way of electric method of even remote control.

Figure 11:
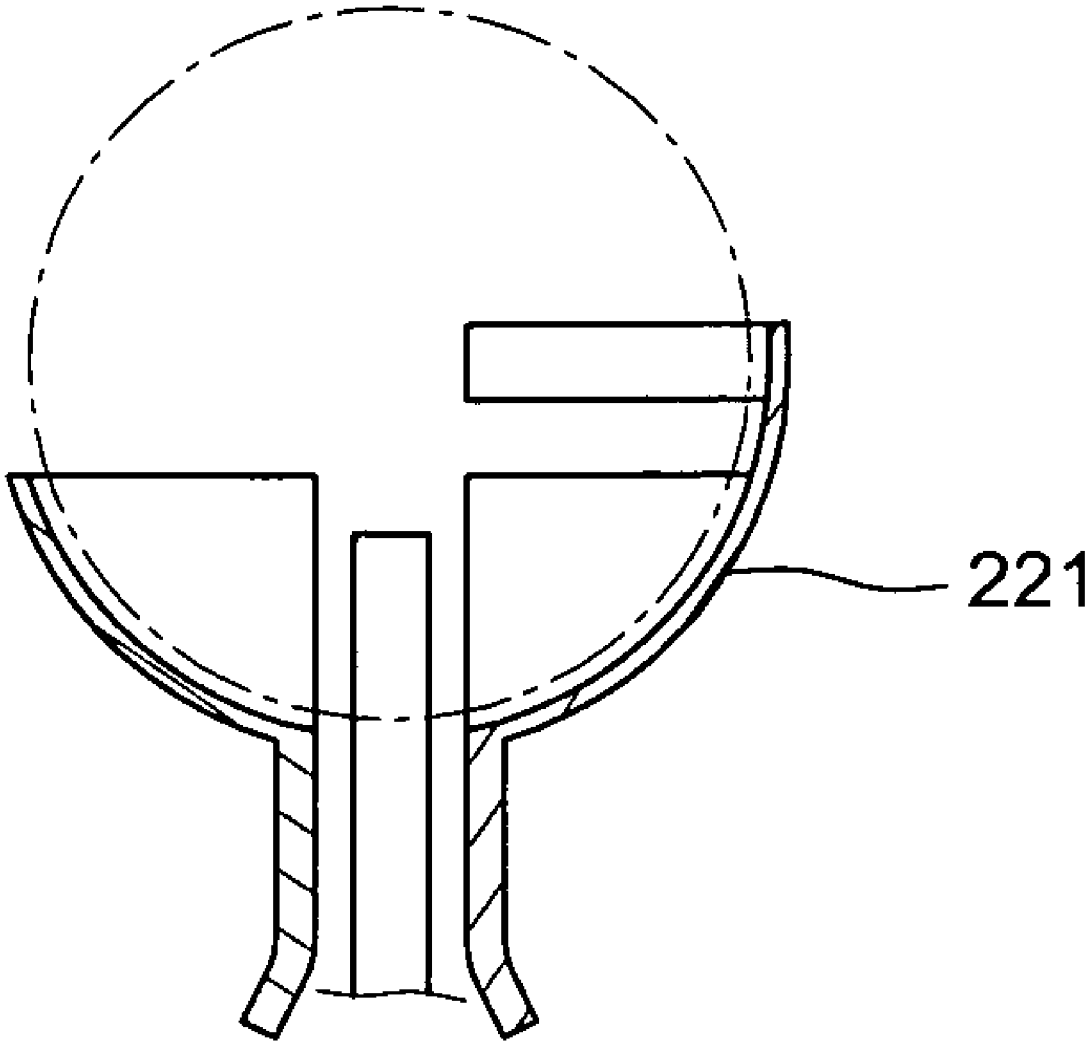
FIG. 11 shows another embodiment of the support member.

FIG. 11 shows another embodiment of the support member 221.

Figure 12:
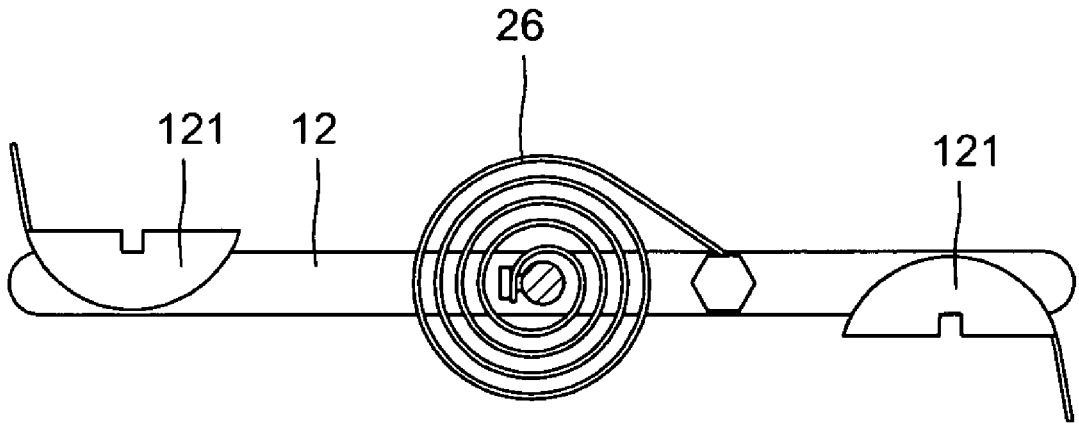
FIG. 12 shows a second embodiment of the pitching device of the present invention.
Figure 13:
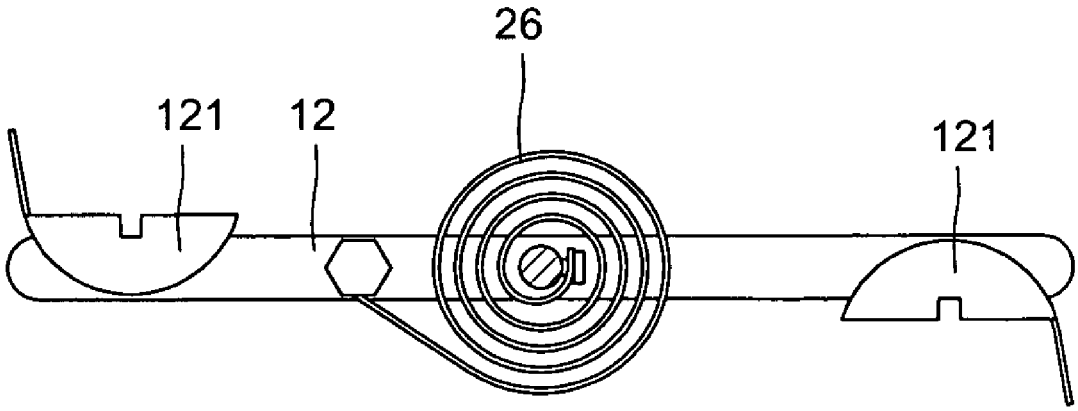
FIG. 13 shows that the strike board of the second embodiment rotates 180 degrees.

FIGS. 12 and 13 show that the driving spring 26 can be a coil spring and the strike board 12 includes two support members 121 respectively connected to two ends thereof. Each ball is thrown when the strike board 12 rotates 180 degrees.

Figure 14:
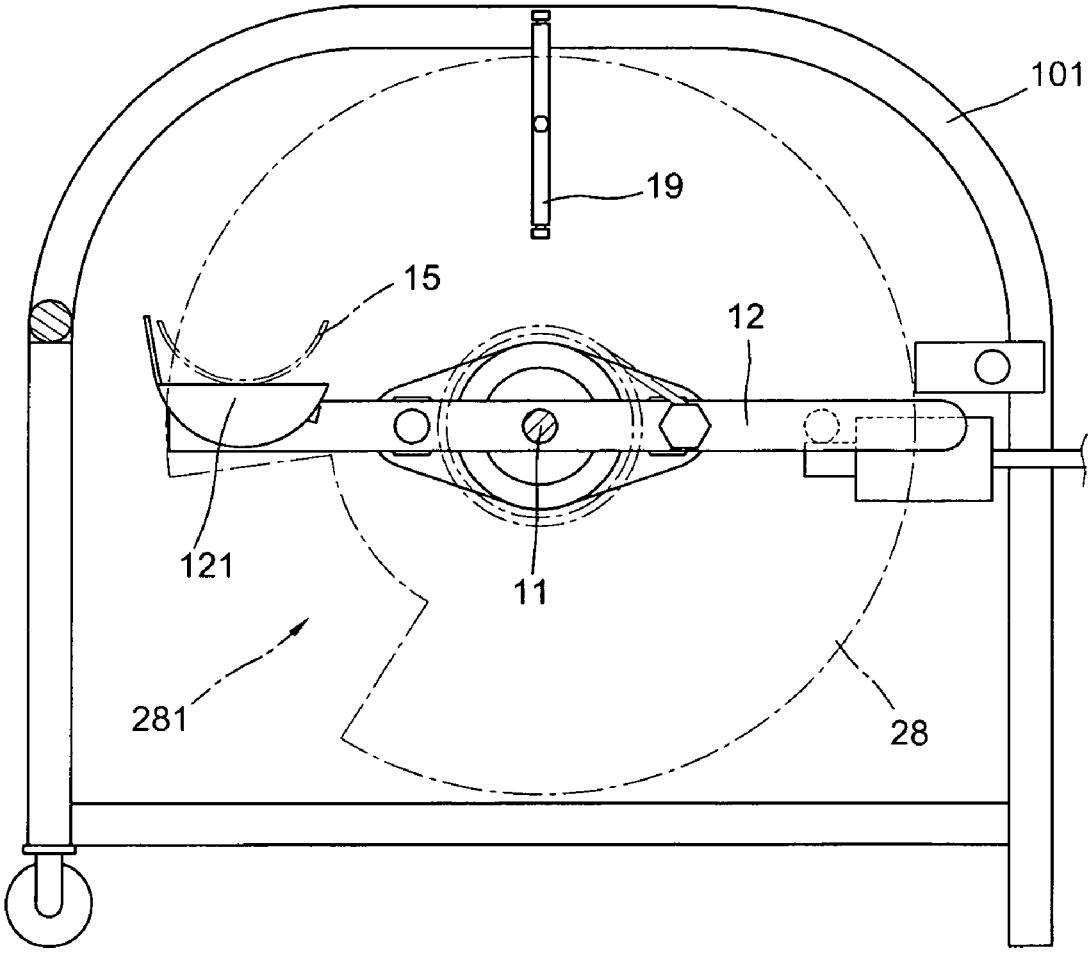
FIG. 14 shows the third embodiment of the pitching device of the present invention.

FIG. 14 shows that the release member 28 is a board and mounted to the shaft 11. A notch 281 is defined in the release member 28 for allowing the ball into the support member 121 via the slide 15. The release member 28 is co-axially connected to the shaft 11 so that the ball enters into the support member 121 via the notch 281 and after the strike board 12 returns to its original position, the release member 28 stops the ball from entering into the support member 121.

Figure 15:
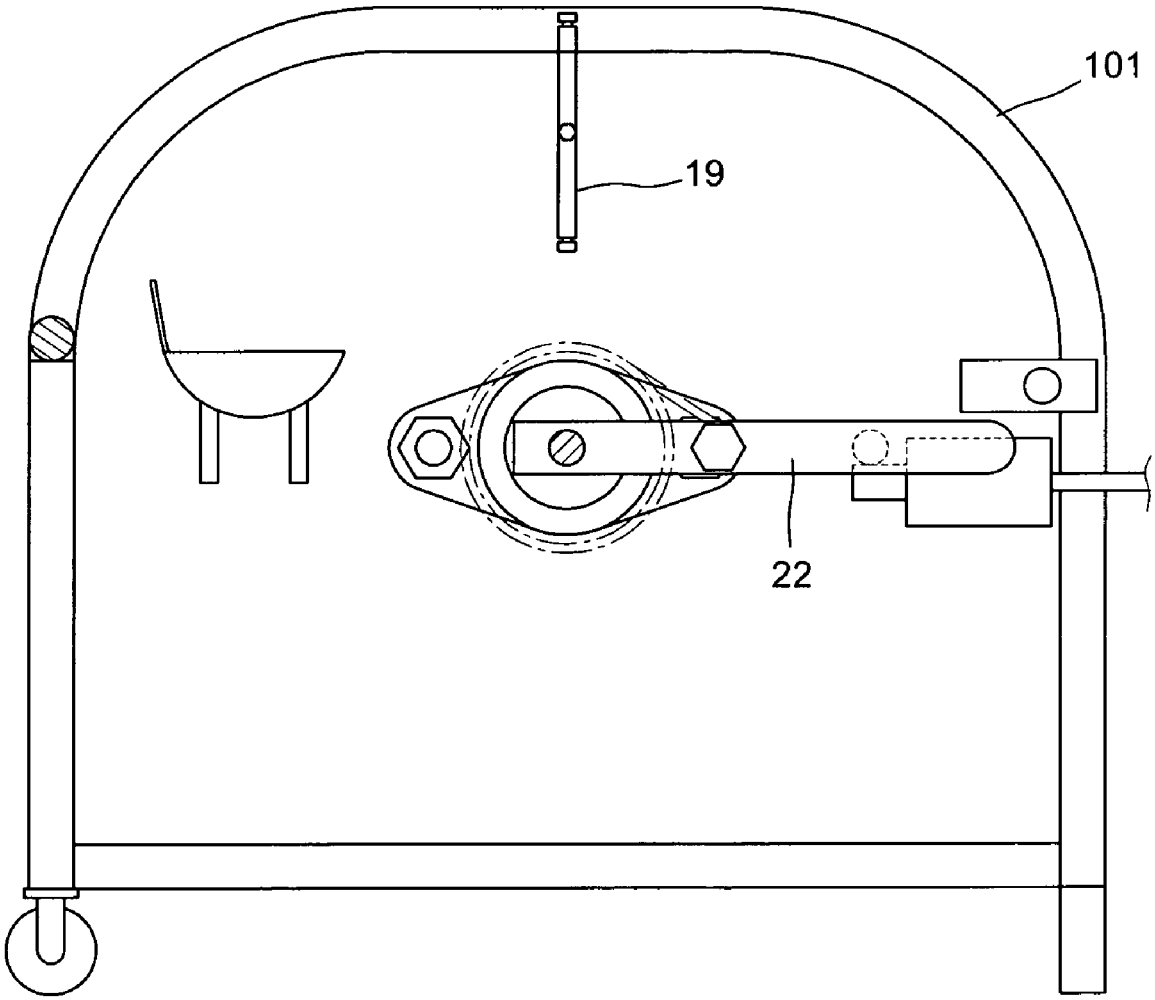
FIG. 15 shows the fourth embodiment of the pitching device of the present invention.

FIG. 15 shows that the strike board 22 is an elongate board whose length is substantially equal to a radius of a rotational path of the strike board 22.

Figure 16:
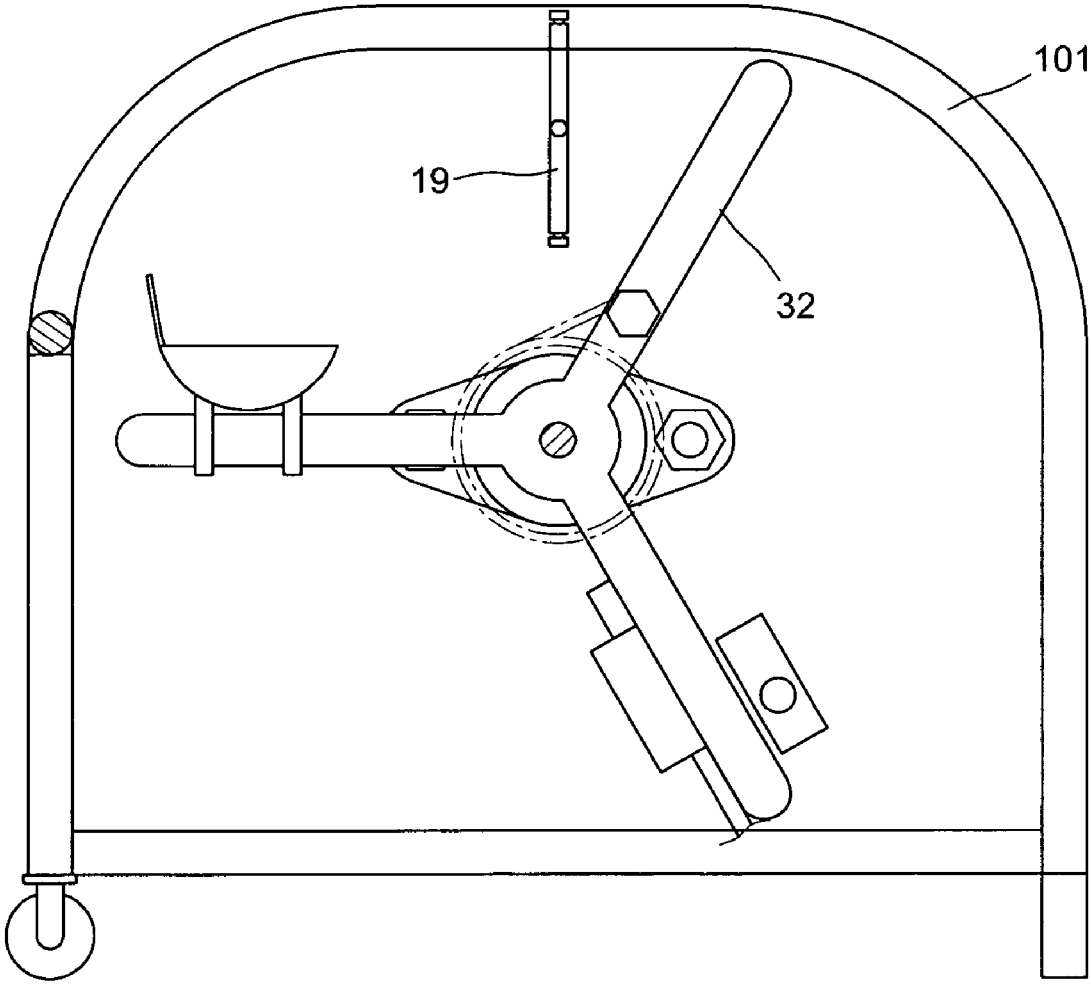
FIG. 16 shows the fifth embodiment of the pitching device of the present invention.

FIG. 16 shows that the strike board 32 includes three elongate boards and a length of each elongate board is substantially equal to a radius of a rotational path of the strike board 32.

While we have shown and described the embodiment in accordance with the present invention, it should be clear to those skilled in the art that further embodiments may be made without departing from the scope of the present invention.

What is claimed is:

1. A pitching device comprising:

a case including multiple frames;

a shaft connected to the frames and having a one-way ratchet and a gear located at one end of the case, a strike board located at the other end of the case, the gear driven by a chain and the one-way ratchet is engaged with a pawl to restrict the one-way ratchet to rotated in one direction only, the pawl connected to a pull spring, the shaft having a driving spring connected thereto;

a press board connected to a first end of the chain and a second of the chain connected to a return member, the driving spring storing torsion force by continuously pressing the press board;

the strike board having a support member for receiving a ball therein, a stop extending from a side of the strike board;

an activation unit having a spring received therein and a protrusion which is connected with a rope, the rope connected with a pedal unit, the protrusion engaged with the stop, the strike board rotating by the driving spring when the protrusion is removed from the stop, and a slide located in the case and a release member located between the slide and the support member, the release member adapted to control the ball into the support member.

2. The pitching device as claimed in claim 1, wherein the driving spring on the shaft is a torsion spring.

3. The pitching device as claimed in claim 1, wherein the driving spring on the shaft is a coil spring.

4. The pitching device as claimed in claim 1, wherein a collar is connected to one of the frames and has a multiple adjustment rods, the adjustment rods are adapted to touch the ball to control the type that the ball is thrown, the support member has multiple notches.

5. The pitching device as claimed in claim 1, wherein a damper is located on a rotational path of the strike board and above the activation unit, the damper is a U-shaped member and includes a gap through which the strike board passes, the strike board touches the U-shaped member which is adapted to reduce speed of the strike board when the strike board passes through the gap.

6. The pitching device as claimed in claim 1, wherein the release member is a ring and includes a resilient holding member, a push member is connected to the holding member and controlled by the support member for not stopping a ball into the support member.

7. The pitching device as claimed in claim 1, wherein the release member is a board and mounted to the shaft, a notch is defined in the release member for allowing a ball into the support member.

8. The pitching device as claimed in claim 1, wherein the strike board is an elongate board whose length is substantially equal to a diameter of a rotational path of the strike board.

9. The pitching device as claimed in claim 8, wherein the strike board includes two support members respectively connected to two ends thereof.

10. The pitching device as claimed in claim 1, wherein the strike board is an elongate board whose length is substantially equal to a radius of a rotational path of the strike board.

11. The pitching device as claimed in claim 1, wherein the strike board includes three elongate boards and a length of each elongate board is substantially equal to a radius of a rotational path of the strike board.

12. The pitching device as claimed in claim 1, wherein the pedal unit includes a pedal and an upright board which is connected to the rope, the upright board pulls the rope when the pedal is pivoted.

* * * * *